US007465057B2

(12) United States Patent
Sandy

(10) Patent No.: US 7,465,057 B2
(45) Date of Patent: Dec. 16, 2008

(54) CLIPBOARD WITH READING LIGHT

(75) Inventor: Bonni Sandy, Morton Grove, IL (US)

(73) Assignee: Dard Products, Inc., Evanston, IL (US)

( * ) Notice: Subject to any disclaimer, the term of this patent is extended or adjusted under 35 U.S.C. 154(b) by 102 days.

(21) Appl. No.: 11/198,205

(22) Filed: Aug. 5, 2005

(65) Prior Publication Data

US 2006/0208477 A1 Sep. 21, 2006

(51) Int. Cl.

| | |
|---|---|
| ***A47B 19/00*** | (2006.01) |
| ***A47B 97/04*** | (2006.01) |
| ***F21V 33/00*** | (2006.01) |
| ***B42D 3/00*** | (2006.01) |

(52) U.S. Cl. ..... 362/98; 362/99; 362/109; 281/45; 248/451

(58) Field of Classification Search ..... 362/98, 362/99, 109, 604; 24/67 R–67 P; 281/45–50; 248/450–453

See application file for complete search history.

(56) References Cited

U.S. PATENT DOCUMENTS

| | | | | | |
|---|---|---|---|---|---|
| 1,456,927 | A * | 5/1923 | Kumpf | 362/99 |
| 2,029,425 | A * | 2/1936 | Kenney et al. | 362/99 |
| 3,297,682 | A * | 1/1967 | Louis et al. | 362/99 |
| 3,694,644 | A * | 9/1972 | Bauknight | 362/99 |
| 4,598,340 | A * | 7/1986 | Dwosh et al. | 362/98 |
| 4,751,620 | A * | 6/1988 | Wright et al. | 362/99 |
| 5,163,748 | A * | 11/1992 | Messinger | 362/98 |
| 5,176,438 | A | 1/1993 | Fisherman | |
| D338,976 | S | 8/1993 | Miley, Jr. | |
| 5,369,560 | A * | 11/1994 | Friedman | 362/396 |
| 5,695,271 | A * | 12/1997 | Zeller | 362/98 |
| 6,022,119 | A * | 2/2000 | Booty, Jr. | 362/98 |
| 6,241,360 | B1 * | 6/2001 | Merrell | 362/99 |
| D459,397 | S | 6/2002 | Zeller et al. | |
| 6,443,588 | B1 * | 9/2002 | Nunez | 362/99 |
| 6,666,563 | B2 * | 12/2003 | Brown | 362/84 |
| D498,554 | S | 11/2004 | Agresto, Sr. | |
| 2003/0179572 | A1 * | 9/2003 | Schnell | 362/191 |
| 2006/0072328 | A1 * | 4/2006 | Chan | 362/382 |

OTHER PUBLICATIONS

International Search Report and The Written Opinion of the International Searching Authority mailed Nov. 11, 2007 in re application No. PCT/US06/29703.

* cited by examiner

*Primary Examiner*—Hargobind S Sawhney
*Assistant Examiner*—David J Makiya
(74) *Attorney, Agent, or Firm*—Kenneth H. Ohriner; Perkins Coie LLP

(57) ABSTRACT

A clipboard has a light assembly built into a clip on the board. The light assembly includes a light head adapted to fit into a recess on the clip. The light head may have a curved top surface matching a curved top surface of the clip head. When in the stored position, the light assembly sits generally flush with the clip. Accordingly, when the light is not needed, it can fold compactly out of the way, and the clipboard can have the shape and size of a conventional clipboard. The light head may be attached to the clip by a link or arm having pivot joints at each end, to allow the light head to be aimed.

17 Claims, 4 Drawing Sheets

FIG. 6
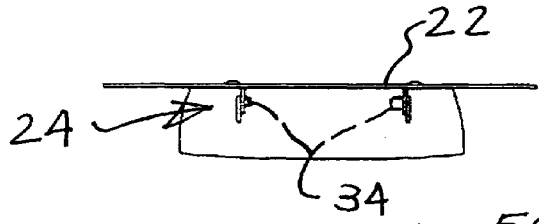
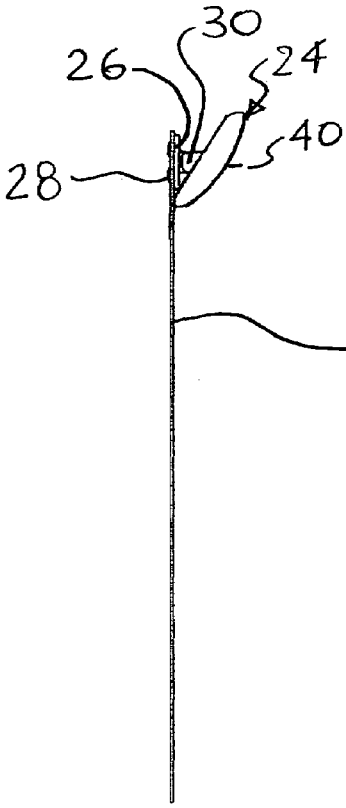
FIG. 7
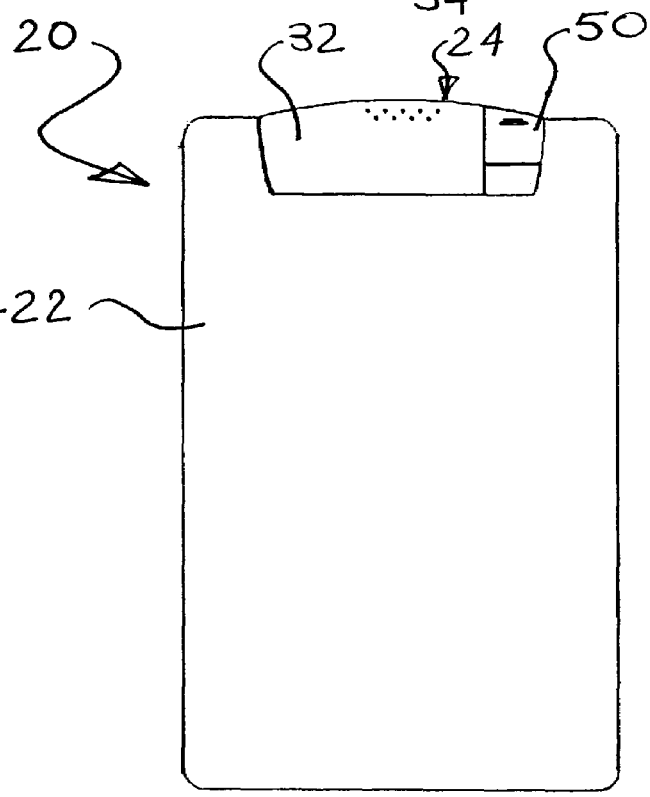
FIG. 4
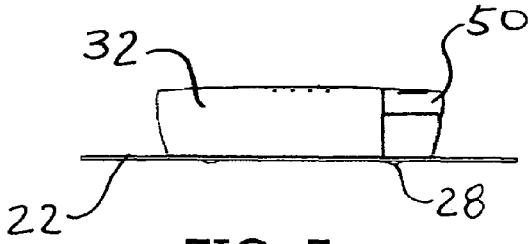
FIG. 5

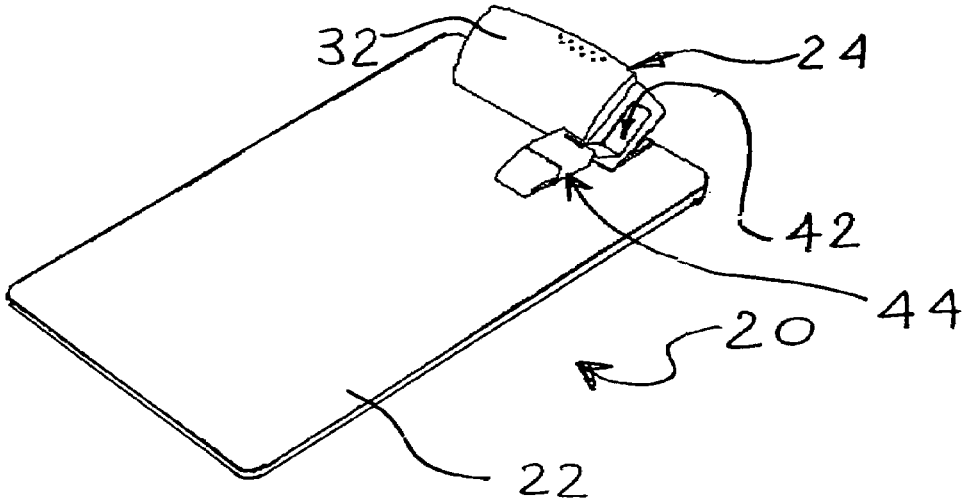
FIG. 8
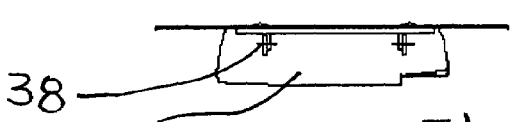
FIG. 11
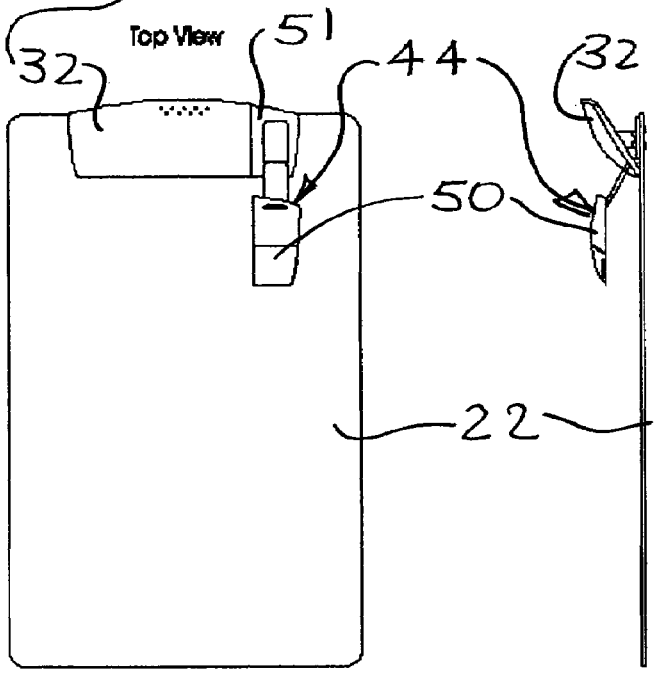
FIG. 9
FIG. 10
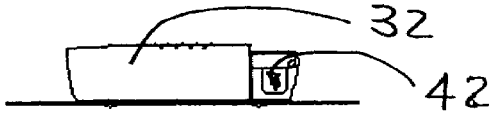
FIG. 12

CLIPBOARD WITH READING LIGHT

BACKGROUND OF INVENTION

The field of the invention is clipboards used for holding papers or other flat items. More specifically, the invention relates to a clipboard having a built-in reading light.

Clipboards are commonly used to hold papers, and to provide a firm writing surface, typically when no other firm and flat writing surface is available or convenient. In the past, clipboards have been provided with battery powered reading lights. A reading light allows the user to read and write in dim or dark lighting conditions, without the need for separately holding a flashlight. These types of clipboards with reading lights typically have an incandescent flashlight bulb supported at the end of a flexible goose-neck supporting arm. This allows the light to be aimed as desired. In these designs, batteries are typically housed in a separate compartment, for example, on the back of the clipboard.

While these types of clipboards with reading lights have met with varying degrees of success in the past, disadvantages remain. For example, with these types of known clipboards, the reading light tends to make the clipboard more bulky. The light components are also subject to damage, as they protrude above the board and clip, and generally have no secure storage location. When these types of clipboards are used in lighted conditions, so that the reading light is not needed, the reading light is still, of course, present or attached to the clipboard, where it can interfere with clipboard use, even though it is not needed.

SUMMARY OF THE INVENTION

A clipboard has a light assembly built into the clip, forming a compact and streamlined design. The light assembly advantageously includes a light head adapted to fit into a recess on the clip. The clip may have a curved clip head, with the light head having a curvature generally matching the curvature of the clip head. As a result, when the light assembly is in a stored position, the clipboard may have a size, shape, configuration, or appearance which is substantially the same as a conventional clipboard (i.e., a clipboard without a reading light). When a reading light is needed, the light assembly is moved into an extended position, via one or more pivot joints or extension elements. Other features and advantages will become apparent from the following detailed description and drawings.

BRIEF DESCRIPTION OF THE DRAWINGS

FIG. 4 is a top or plan view.

FIG. 5 is a bottom end view.

FIG. 6 is a top end view.

FIG. 7 is a left side view.

FIGS. 1-7 show the clipboard with the reading light in the stored or retracted position.

FIGS. 8-14 show the reading light in an extended position.

FIG. 8 is a perspective view of the clipboard shown in FIG. 1, with the reading light in an extended position.

FIG. 9 is a front view.

FIG. 10 is a right side view.

FIG. 11 is a top end view.

FIG. 12 is a bottom end view.

FIG. 13 is an enlarged right side view showing the light and clip.

FIG. 14 is a top view of the elements shown in FIG. 13.

DETAILED DESCRIPTION OF THE DRAWINGS

Figure 2:
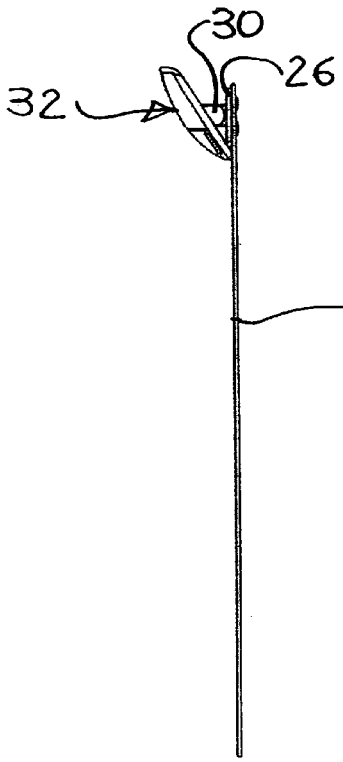
FIG. 2 is a right side view.

Turning now in detail to the drawings, as shown in FIGS. 2 and 7, a clipboard 20 has a clip assembly 24 which may include a flat base or foot 26 attached to a board 22 via rivets 28 or other fasteners or adhesives. The clip assembly 24 may include a clip post 30 on the base 26 supporting a clip head 32. One or more spring elements 34 (shown in FIG. 6) bias the clip head 32 into a down position, with the lower edge of the clip head 32 pressing against the base 26 or the board 22, to hold papers in place on the clipboard 20. The forward edge of the base 26 may form a step or ridge 36, to allow the clip head 32 to better clamp papers in place. Referring to FIG. 11, the clip head 32 pivots about pins 38 or other pivot attachments, to clamp or release papers on the clipboard 20. The details of the base 26, rivets 28, post 30, spring 34, step 36, or pins 38 are not essential, and may be changed, or omitted, depending on the specific designs selected.

Figure 1:
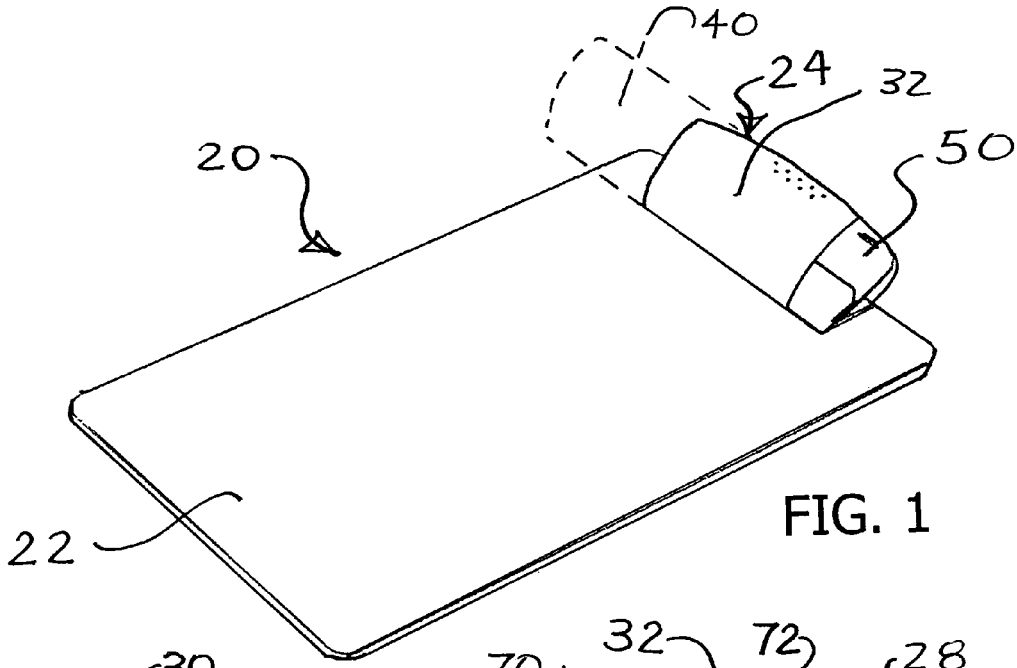
FIG. 1 is a perspective view of the present clipboard.
Figure 13:
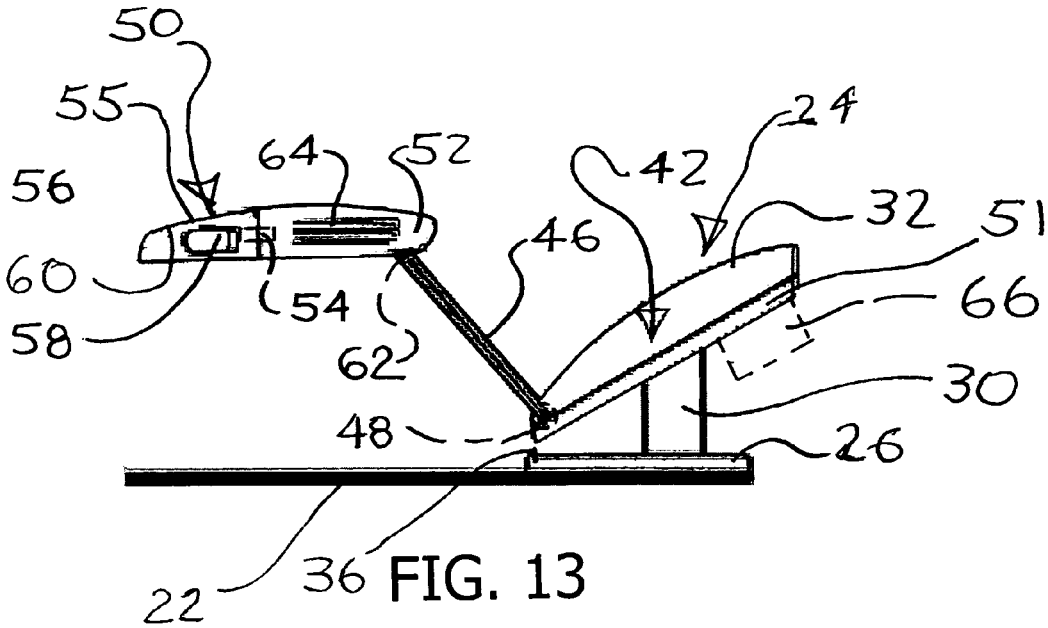

Referring to FIGS. 1 and 13, the clip head 32 may have a flat top surface or a curved top surface, defining a curved plane 40. As shown in FIG. 8, a recess or slot 42 is provided at one side of the clip head 32 to accommodate a light assembly 44.

Figure 14:
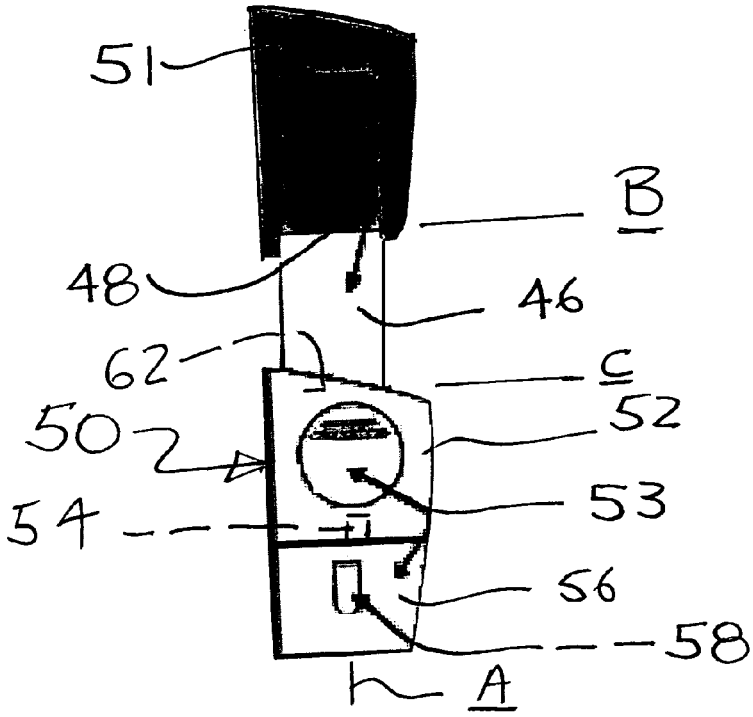

Turning now to FIGS. 8-14, the light assembly 44 has an arm 46 attached to a head plate or area 51 (shown in FIG. 9) on the clip head 32, advantageously at a first pivot joint 48 (shown in FIG. 13). A light head 50, shown in FIGS. 13 and 14, can be pivotably attached to the other end of the arm 46 e.g., at a second pivot joint 62. As shown in FIGS. 13 and 14, the light head 50 may have a rear section formed as a battery case 52, and a front section formed as a lamp or LED holder 56. The battery case 52 can be attached to the upper or outer end of the arm 46 at the outer pivot joint 62. If the lamp holder 56 is pivotably attached to the battery case 52 at a pivot or rotation joint 54 as shown in FIG. 14, the lamp holder 56 can pivot or rotate about axis A, shown in FIG. 14. The arm 46 and light head 50 can then pivot about axis B (at joint 48) and axis C at joint 62. Axis A is substantially perpendicular to axis C, which is substantially parallel to axis B.

A lamp or LED 58 is held within the lamp holder 56. A reflector 60 may be provided around the LED 58, as shown in FIG. 13. A lid 53 on the battery case 52, shown in FIG. 14, can be used to open the battery case 52 to change the batteries. The battery case 52 may hold various types of batteries for powering the LED 58, for example, one or two watch batteries (2016, etc.). A switch 64 on the side of the battery case 52 switches the LED 58 on or off. The pivot or rotation joints 48, 62, and 54 are advantageously provided with sufficient friction to hold the light assembly 44 in any position. Alternatively, the joints may allow pivoting movement without substantial friction, and positioning achieved via detents or mechanical stops.

As shown in dotted lines in FIG. 13, in an alternate embodiment, a battery compartment 66 may be provided elsewhere on the clipboard 20, such as on the back or bottom side of the clip head 32.

Figure 3:
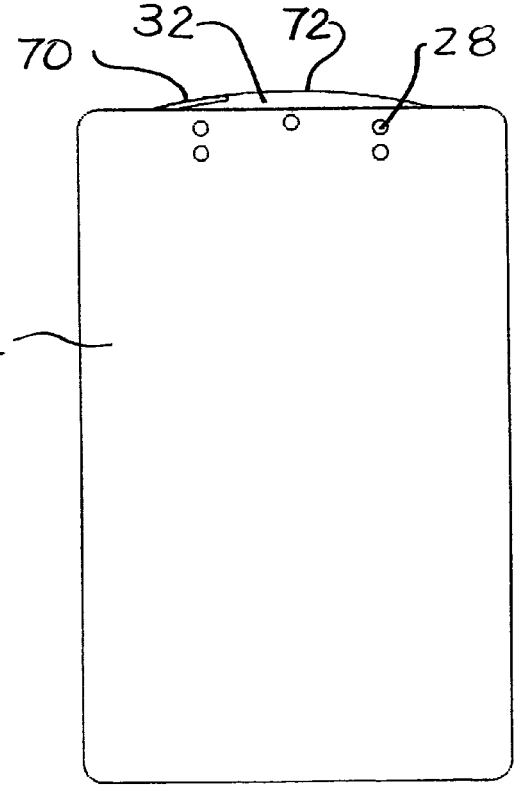
FIG. 3 is a back view.

Referring to FIG. 3, the back edge 70 of the light head 50 may have a curvature generally matching any curvature of the back edge 72 of the clip head 32. The light head 50 may have a top surface 55, shown in FIG. 13, having the same curvature, shape, and/or dimensions as the top surface of the clip head 32. In this design, when the light assembly 44 is in the stored position, as shown in FIGS. 1-7, the arm 46 is folded into the recess 47 and the light head 50 essentially merely forms an extension of the clip head 32. Specifically, the top surface 55 of the light head 50 aligns with, or lies in the same plane of curvature 40 as the top surface of the clip head 32. Similarly, the back edge 70 of the light head 50 may conform with the back edge 72 of the clip head 32. Accordingly, when in the stored position, shown in FIGS. 1-7, the light assembly 44 is out of the way, within a compact space, and with no protruding components.

In addition, the full width of the clip head 32 plus the width of the light head 50, may be pushed on by the user's palm or fingers, to pivot the clip head 32 up, to release papers from the clipboard 20. As shown in FIG. 1, the combination of the clip head 32 and light head 50 is generally centered on the board 22. The clipboard 20, with the light assembly 44, retracted, as shown in FIGS. 1-7, therefore may feel, act, and/or look like a conventional clipboard.

The light assembly 44 is used by pulling or lifting the light head 50 up or away from the head plate 51 on the clip head 32. With this movement, the arm 46 pivots (counter-clockwise in FIG. 13 at joint 48). The light head 50 correspondingly pivots clockwise about joint 62. The height of the light head 50 above the board 22, as well as the angle of the light head 50 relative to the board 22, can therefore be set or adjusted by the user. The LED 58 is turned on by the switch 64. Light emitted by the LED 58 can be aimed (in a top to bottom direction) by adjusting the position and angle of the light head 50. The light may also be adjusted in a left to right direction by turning the lamp holder 56. As a result, in addition to illuminating papers on the clip board 20, the light assembly 44 may also be used as a small positionable flashlight by turning the lamp holder 56 to one side, or even by one-half turn, so that light from the LED projects upwardly, away from the board 22.

While use of one light assembly 44 is generally sufficient for most clipboard uses, in an alternative embodiment, a second mirror image light assembly may in addition be provided on the other (left) side of the clip head 32 to provide additional light. The arm 46 and pivot joints 48, 54, and/or 62 may be replaced in whole or part by other mechanical elements, such as a flexible arm or wire, which allows for extension and positioning of the light head, and also for compact storage of the light head, within the profile of the clip head.

Thus, a novel clipboard and light assembly has been shown and described. Various change and substitutions may of course be made, without departing from the spirit and scope of the invention. The invention, therefore, should not be limited, except by the following claims, and their equivalents.

The invention claimed is:

1. A clipboard comprising a substantially flat board providing a writing surface; a clip assembly permanently attached to the board and adapted to hold papers onto the board, with the clip assembly including a clip head pivotable relative to the board and a spring biasing a lower edge of the clip head into contact with the board, and with the board longer and wider than the clip head; an open recess positioned on one side and defined by a width and a side face of the stepped-down thickness of the clip head; an arm pivotably attached to the clip head with a first pivot joint on the clip head, and with the first pivot joint fixed in position on the clip head; a light head pivotably attached to the arm with a second pivot joint, and the light head including a battery compartment supported by the arm, and a lamp holder pivotably attached to the battery compartment; the light head movable on the arm from a retracted position, wherein the light head and the arm are within the recess, to an extended position, wherein the light head is spaced apart from the clip head and with the clip head having a curved top surface and a head plate at one end of the clip head, and with the light head having a size and shape so that with the light head positioned entirely in the recess, a top surface of the light head is substantially aligned with the top surface of the clip head.

2. The clipboard of claim 1 with the clip head having a width W and the arm having a length substantially equal to W.

3. The clipboard of claim 1 with the arm having a length L and with the light head having a length substantially equal to L.

4. The clipboard of claim 1 with the clip head having a curved top surface and a head plate at one end of the clip head, and with the light head having a size and shape so that with the light head positioned on the head plate, a top surface of the light head is substantially aligned with the top surface of the clip head.

5. The clipboard of claim 1 wherein the arm is substantially straight and rigid, and has a fixed length.

6. The clipboard of claim 1 with a first end of the arm attached to the clip head at the first pivot joint, to allow the arm to pivot relative about a first axis, and with the light head attached to a second end of the arm at the second pivot joint, to allow the light head to pivot about a second axis parallel to the first axis; and with the light head comprising a lamp holder pivotable about a third axis substantially perpendicular to the second axis.

7. A clipboard comprising a board having a front side and a back side, with the front side providing a surface for supporting papers; a clip assembly including a base permanently attached onto the front side of the board, adjacent to an edge of the board; a clip head pivotably attached to the base, and the board longer and wider than the clip head, an open recess positioned on one side and defined by a width and a side face of the stepped-down thickness of the clip head, a spring element urging a first end of the clip head in a direction toward the front side of the board, to hold an article onto the front side of the board; an arm having a first end and a second end, and a fixed length, with the first end of the arm pivotally attached to the clip head via a first pivot connection on the clip head and adjacent to a lower edge of the clip head, and a light head pivotally attached to the second end of the arm via a second pivot connection, with the light head having a length substantially equal to the length of the arm and with the clip head having a curved top surface and a head plate at one end of the clip head, and with the light head having a size and shape so that with the light head positioned entirely in the recess, a top surface of the light head is substantially aligned with the top surface of the clip head.

8. The clipboard of claim 7 with the light assembly comprising a light head adapted to fit into a recess on the clip, and with the clip having a curved clip head, and with the light head having a curvature generally matching the curvature of the clip head.

9. The clipboard of claim 7 with the light head comprising a switch.

10. The clipboard of claim 7 with the light head comprising a battery compartment, an LED holder, and an LED in the LED holder.

11. The clipboard of claim 10 with the LED holder pivotably attached to the battery compartment.

12. The clipboard of claim 7 wherein the clip includes a clip head, and where the light head is moveable from a retracted position wherein the light head is substantially coplanar with the clip head, to an extended position, wherein the light head is spaced apart from the clip head.

13. The clipboard of claim 7 wherein the light assembly is located at one side of the clip.

14. Clipboard comprising a generally rectangular board having two longer edges and two shorter edges; a base attached to the board adjacent to first one of the shorter edges, one or more posts attached to the base on a first side of the board, a clip head pivotally supported on the posts, with the board longer and wider than the clip head; an open recess positioned on one side and defined by a width and a side face of the stepped-down thickness of the clip head; a spring biasing an edge of the clip head towards a front surface of the board for holding flat articles onto the first side of the board; a light assembly on the clip head with the light assembly comprising an arm having a first end and a second end, and a fixed length with the first end of the arm pivotally attached to the clip head via a first pivot joint on the clip head adjacent to a lower edge of the clip head, and the arm pivotable about the first pivot joint in a first axis generally parallel to the first edge of the board; a light head pivotally attached to the second end of the arm via a second pivot joint, and the light head pivotable about the second pivot joint in a second axis, substantially parallel to the first axis, and with the light head having a length substantially equal to the length of the arm; the light head movable on the arm in an arc about the first pivot joint, from a retracted position, wherein the light head and the arm are within the recess in the clip head, to an extended position, wherein the light head is spaced apart from the clip head and positioned over the first side of the board; and with the clip head having a curved top surface and a head plate at one end of the clip head, and with the light head having a size and shape so that with the light head positioned entirely in the recess, a top surface of the light head is substantially aligned with the top surface of the clip head.

15. The clipboard of claim 14 with the base permanently attached to the first side of the board.

16. The clipboard of claim 14 with the light assembly located at one side of the clip head.

17. The clipboard of claim 14 with the light head comprising a lamp holder pivotable about a third axis substantially perpendicular to the second axis.

* * * * *